US005666920A

United States Patent [19]

Ito et al.

[11] Patent Number: 5,666,920

[45] Date of Patent: Sep. 16, 1997

[54] FUEL SUPPLY SYSTEM FOR USE WITH INTERNAL COMBUSTION ENGINE

[75] Inventors: Yoshihiko Ito, Aichi-ken; Yasuhide Tani, Nagoya, both of Japan

[73] Assignee: Nippondenso Co., Ltd., Kariya, Japan

[21] Appl. No.: 193,852

[22] Filed: Feb. 9, 1994

[30] Foreign Application Priority Data

Feb. 12, 1993 [JP] Japan ..... 5-024189

[51] Int. Cl.[6] ..... F02M 69/04

[52] U.S. Cl. ..... 123/432; 123/531

[58] Field of Search ..... 123/531, 533, 123/472, 470, 585; 239/533.12, 533.14

[56] References Cited

U.S. PATENT DOCUMENTS

| | | | |
|---|---|---|---|
| 4,219,157 | 8/1980 | Binoche . | |
| 4,325,341 | 4/1982 | Yamauchi et al. | 123/472 |
| 4,519,370 | 5/1985 | Iwata | 123/472 |
| 4,982,716 | 1/1991 | Takeda et al. | 123/531 |
| 5,129,381 | 7/1992 | Nakajima . | |
| 5,211,682 | 5/1993 | Kadowaki et al. . | |
| 5,220,899 | 6/1993 | Ikebe et al. | 123/531 |
| 5,220,900 | 6/1993 | Wakeman . | |

FOREIGN PATENT DOCUMENTS

| | | |
|---|---|---|
| 480329 | 4/1992 | European Pat. Off. . |
| 0539614 | 5/1993 | European Pat. Off. . |
| 419206 | 12/1991 | Germany . |
| 4218896 | 12/1992 | Germany . |
| 57-164252 | 10/1982 | Japan . |
| 60-3278 | 1/1985 | Japan . |
| 63-160376 | 10/1988 | Japan . |
| 63-314363 | 12/1988 | Japan . |
| 64-24161 | 1/1989 | Japan . |
| 4-50469 | 2/1992 | Japan . |
| 4-50472 | 2/1992 | Japan . |

*Primary Examiner*—Marguerite McMahon
*Attorney, Agent, or Firm*—Cushman, Darby & Cushman IP Group Pillsbury Madison & Sutro LLP

[57] ABSTRACT

The present invention makes it possible to obtain good characteristics of forming sprays of fuel jetted through a plurality of injection ports of a fuel injection valve with respect to separation of sprays in different directions, atomization, jetting angles and penetrating force.

Fuel jetted through the injection ports of the fuel injection valve is jetted in separate jets from a plurality of fuel flow separating holes of a sleeve nozzle. On the other hand, band-like assist air flows are jetted in a two-dimensional manner from slit-like air holes opened on the opposite sides of the fuel flow separating holes to impinge obliquely against the jetted fuel. Atomization of fuel jetted through the plurality of fuel flow separating holes is thereby promoted and fuel sprays are accurately separated and supplied independently in two directions toward two intake valves while the directions of jets from the injection ports of the fuel injection valve are maintained, thus injecting and supplying fuel. As a result, an amount of fuel impinging directly against walls which separates and forms two intake ports is reduced and an amount of atomized sprayed fuel directly entering a combustion chamber from the intake ports is therefore increased, thereby improving combustion characteristics.

16 Claims, 12 Drawing Sheets

FUEL SUPPLY SYSTEM FOR USE WITH INTERNAL COMBUSTION ENGINE

BACKGROUND OF THE INVENTION

1. Field of the Invention

This invention relates to a fuel supply system for use with internal combustion engines and, more particularly, to a fuel supply system in which assist air is supplied to a fuel injection valve to improve atomization of fuel.

2. Description of the Related Art

A fuel supply system is known in which a fuel injection valve is provided in an intake pipe on the upstream side of an intake port of an internal combustion engine, and an air-fuel mixture in which a fuel from the fuel injection valve and air are preliminarily mixed is supplied to the engine. Pulverization or atomization of the injected fuel and the atomized state of the fuel are controlled so as to improve combustion characteristics.

If a combustion chamber is provided with two intake valves for the purpose of achieving high-speed and high-power performance of an internal combustion engine, it is necessary to evenly distribute fuel from a fuel injection valve in the vicinity of an intake port to the two intake valves. To achieve this effect, a fuel injection valve has been proposed which is designed so as to form bundles of fuel spray by separating fuel flow in two directions from the fuel injection valve (Japanese Patent Unexamined Publication No. 4-50472). In this case, fuel is jetted from two injection holes so that two fuel flows are evenly directed toward the two intake valves. Simultaneously, air and fuel are caused to impinge against and mix with each other so that injected fuel is finely pulverized.

For example, in the case where, as shown in FIG. 3, fuel is to be jetted from a fuel injection valve 1 toward two intake valves 101 and 102 of a combustion chamber, fuel pulverization/atomization characteristics cannot be improved sufficiently, although fuel jetted from the injection holes can be separated into two flows.

The inventors of the present invention has experimentally found the following fact. If a main air hole is provided at a position between two injection holes for separating a fuel spray in the fuel injection system disclosed in Japanese Patent Unexamined Publication No.4-50472, it is necessary to supply air through the main air hole at a very high flow rate in order to separate a fuel spray in two directions. For example, fuel jets from the two injection holes cannot be separated suitably unless the area of a sub air hole is made smaller than that of the main hole so that the area ratio (main air hole area)/(sub air hole area) is about 6. With respect to non-supercharging introduction of air from the upstream side of an intake throttle valve to a fuel injection valve in an internal combustion engine, there is a limit to the maximum air flow rate in view of idling, at which air can be introduced into the fuel injection valve, for a reason relating to the internal combustion engine system. For example, the maximum air flow rate is limited to 1.3 $m^3/h$. Therefore, if the main air hole and the fuel injection holes are spaced apart from each other as in this fuel injection system, the air flow cannot be utilized effectively and it is difficult to suitably pulverize or atomize fuel.

SUMMARY OF THE INVENTION

An object of the present invention is to improve a fuel supply system for atomizing fuel with assist air.

Another object of the present invention is to prevent excessive spreading of a spray of atomized fuel while improving fuel atomization.

Still another object of the present invention is to improve atomization of fuel while maintaining a fuel spray in suitable directions.

A further object of the present invention is to provide a fuel supply system for forming fuel sprays flowing in a plurality of directions in which atomization of fuel is promoted while excessive spreading of atomized fuel sprays is prevented, and in which fuel sprays can be maintained in a plurality of directions.

To achieve these objects, according to the present invention, there is provided a fuel supply system for internal combustion engines comprising fuel injection port means which opens toward intake ports of the internal combustion engine, fuel injection valve means having a valve member for opening and closing the fuel injection port means, and a sleeve nozzle having fuel flow separating holes provided on the fuel injection downstream side of the fuel injection port means to separate a spray of fuel jetted from the fuel injection port means into flows in a plurality of different directions, and a plurality of slit-like air holes for jetting assist air in a band-like manner such that the assist air impinges against fuel sprays separately jetted from the fuel flow separating holes from the opposite sides of the fuel sprays.

With this arrangement of the present invention, fuel jet from the fuel injection hole of the fuel injection valve is jetted through the fuel flow separation holes of the sleeve nozzle while being separated into different flows. Simultaneously, flat jets of assist air flow from the slit-like air holes opened on the opposite sides of the fuel flow separating holes to impinge obliquely against the jetted fuel. The fuel atomization is achieved by the band-like air flow from the air holes close to the injection port means while keeping fuel flow direction. Therefore, fuel sprays blown toward, for example, two intake valves such as those shown in FIG. 3 are sprayed while being separated in two directions toward the respective intake valves. As a result, the amount of fuel impinging directly against walls forming the two intake ports is reduced and the amount of atomized sprayed fuel directly entering a combustion chamber from the intake ports is therefore increased, thereby improving combustion characteristics.

DETAILED DESCRIPTION OF THE PREFERRED EMBODIMENTS

The preferred embodiments of the present invention will be described below with reference to the accompanying drawings.

The first embodiment of the present invention in which the invention is applied to a fuel supply system for gasoline internal combustion engines will be described with reference to FIGS. 1 to 8.

Figure 2:
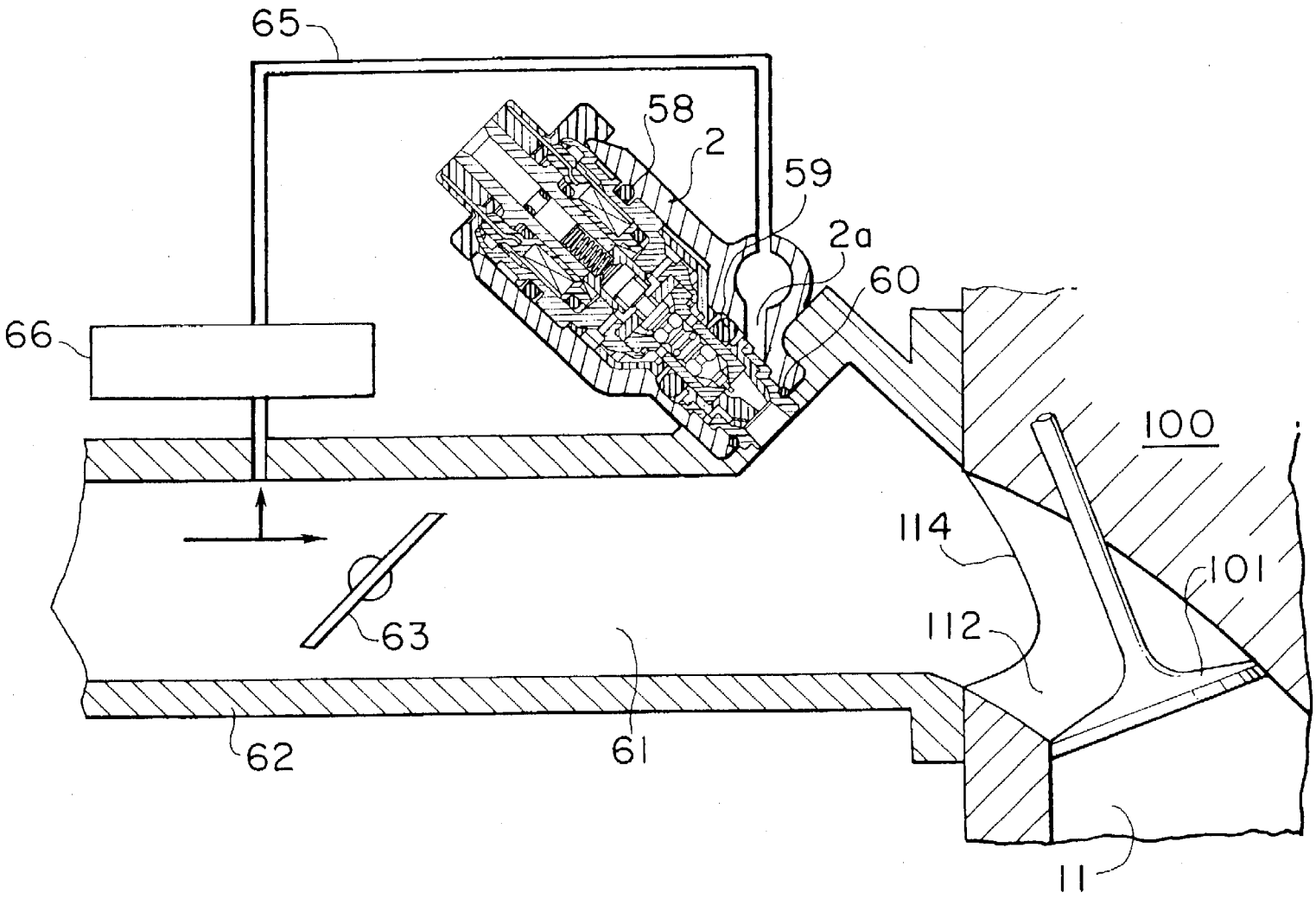
FIG. 2 is a schematic cross-sectional view of an intake system of an internal combustion engine to which the first embodiment is applied.
Figure 3:
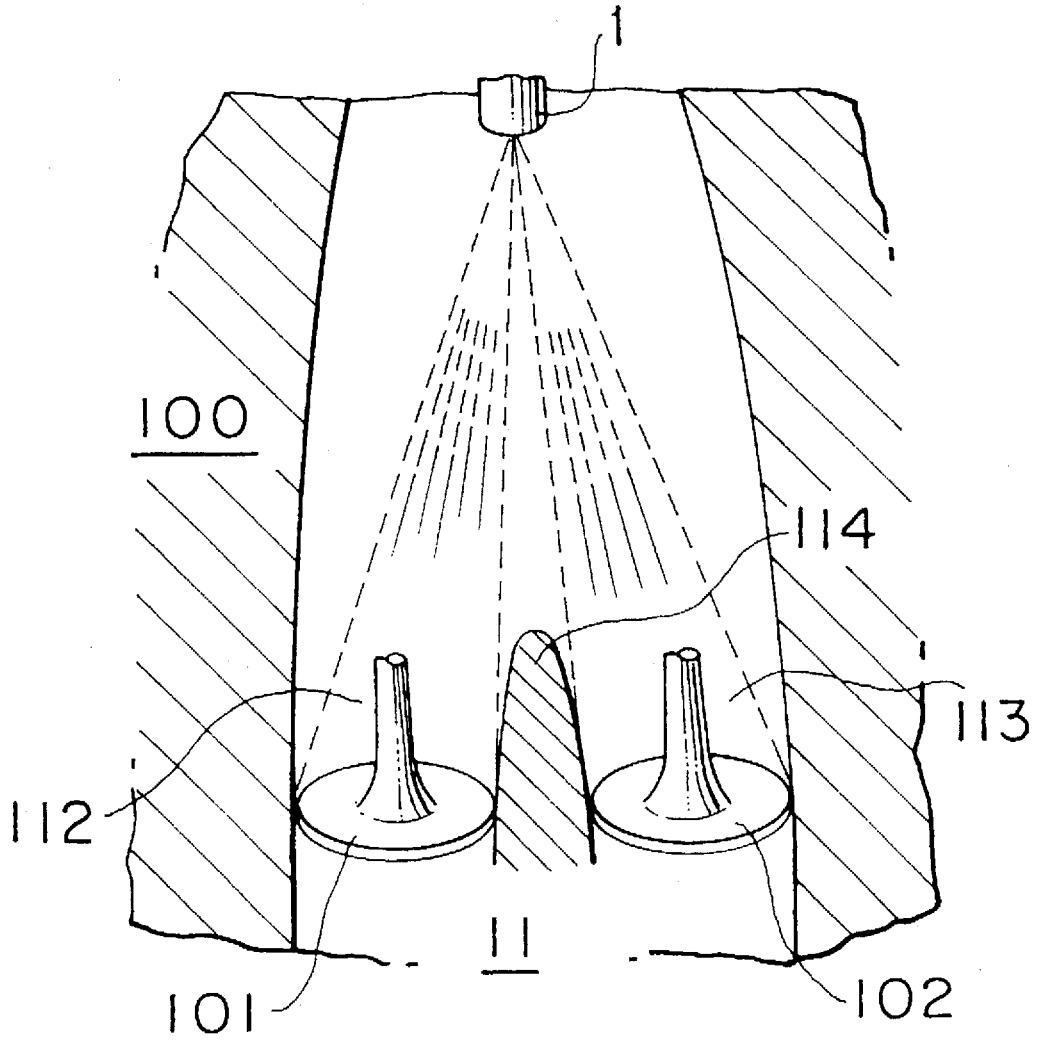
FIG. 3 is a schematic view of the shape of intake ports of the internal combustion engine to which the first embodiment is applied.

As shown in FIGS. 2 and 3, intake valves 101 and 102 are mounted in an internal combustion engine 100 at intake ports 112 and 113 which open to a combustion chamber 11. The intake valves 101 and 102 are operated to open and close the openings of the intake ports 112 and 113. A wall 114 is formed between the intake ports 112 and 113 to separate these ports. An intake pipe 62 has an intake passage 61 which communicates with the intake port 112. An intake throttle valve 63 for opening and closing the intake passage 61 is turnably mounted in the intake pipe 62. A fuel injection valve 1 is mounted in an outer wall of the intake pipe 62 on the downstream side of the intake throttle valve 63 so as to spray fuel toward each of the intake valves 101 and 102. Also, an air supply passage 65 is provided which communicates the intake passage 61 on the upstream side of the intake throttle valve 63 with an assist air passage of the fuel injection valve 1 to be described later. An electromagnetic valve 66 is provided in an intermediate portion of the air supply passage 65 to adjust the rate at which assist air is supplied to the fuel injection valve 1.

Figure 4:
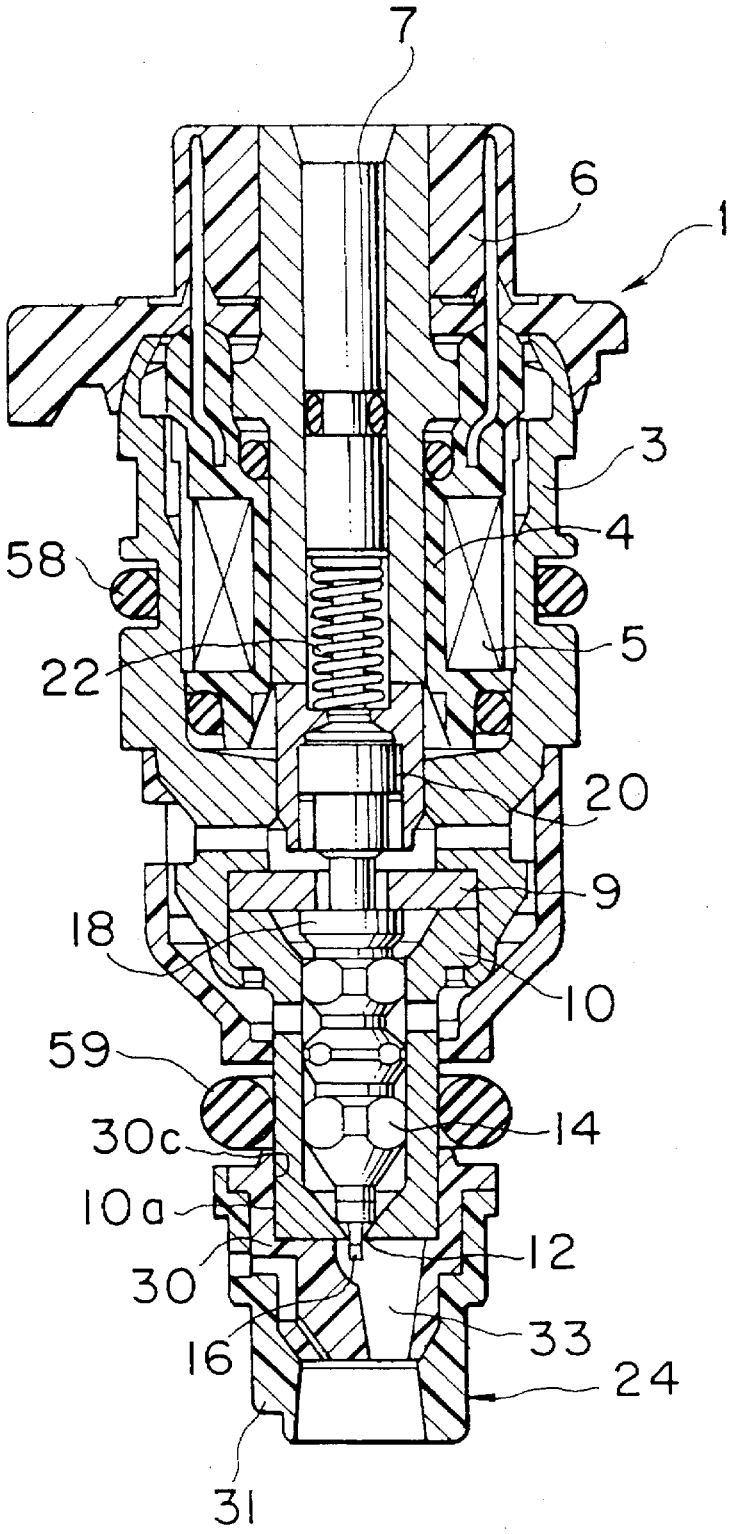
FIG. 4 is a cross-sectional view of a fuel injection valve of the first embodiment.

As shown in FIG. 4, the fuel injection valve 1 which is operated electromagnetically is mounted in a delivery pipe 2 shown in FIG. 2. The delivery pipe 2 supplies fuel to each of cylinders of the internal combustion engine. The fuel injection valve 1 has a housing 3 having the form of a stepped cylinder. An electromagnetic coil 5 is disposed in a large-diameter portion of the housing 3 to be wound around a spool 4. A cylindrical iron core 6 is provided to extend through the spool 4 from a position above the spool 4. An adjusting pipe 7 is provided in the iron core 6 slidably in an axial direction.

A nozzle body 10 is fitted onto and fixed to a small-diameter portion of the housing 3 with a spacer 9 interposed therebetween. A fuel injection port 12 is formed in an end surface of a downwardly projecting portion of the nozzle body 10. A needle valve 14 is slidably inserted in the nozzle body 10 from the upper opening of the same. A pintle 16 is formed at a tip end of the needle valve 14. The pintle 16 extends through the fuel injection port 12 with a gap therebetween. A stopper 18 is formed substantially at a center of the needle valve 14 so as to face the spacer 9. A movable core 20 facing the iron core 6 is connected to an upper end portion of the needle valve 14. The movable core 20 is urged downward by a coil spring 22 disposed between the iron core 6 and the adjusting pipe 7. At the end portion of the nozzle body 10 in which the fuel injection port 12 is formed, a split type resin sleeve 24 is provided to surround the end portion of the nozzle body 10.

Figure 1:
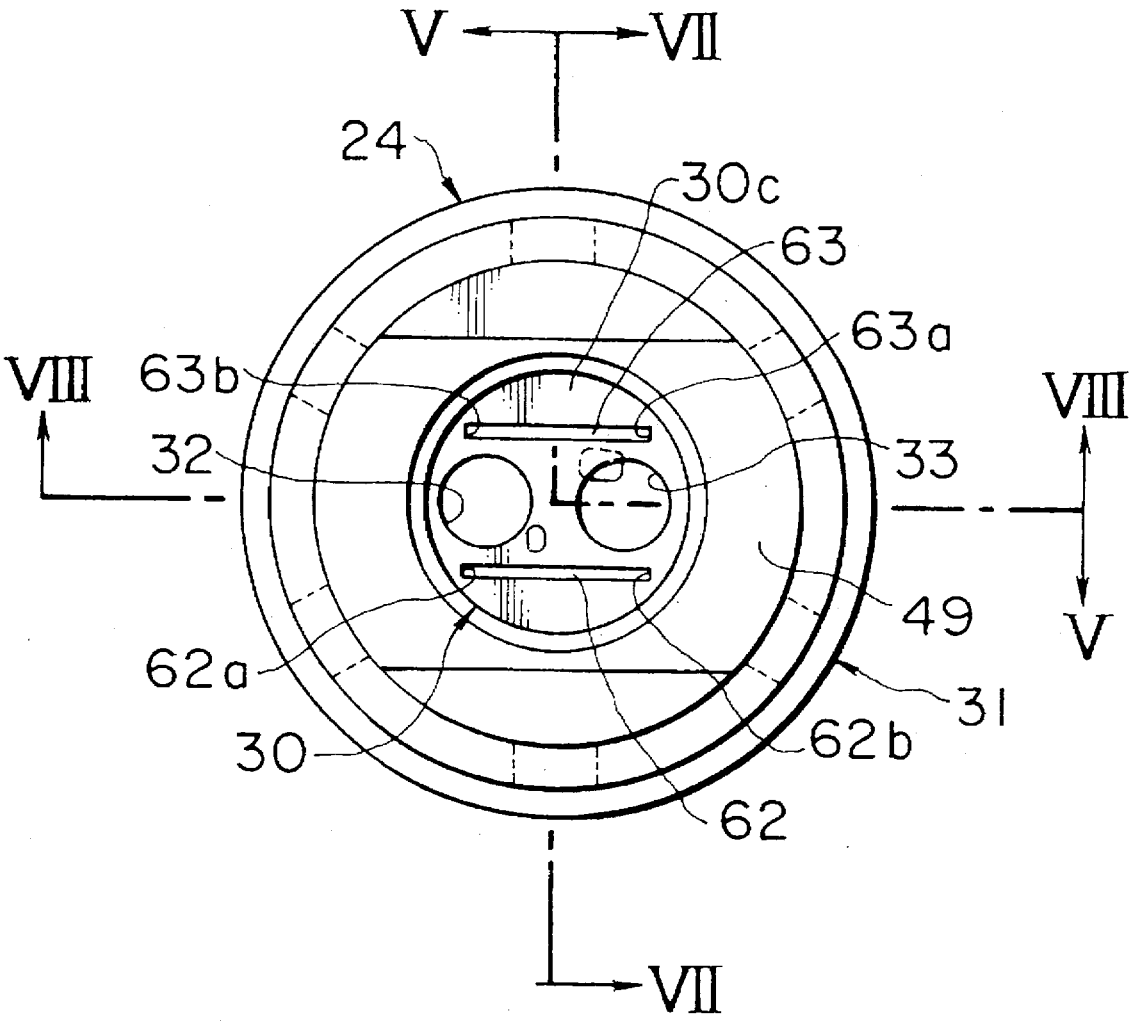
FIG. 1 is a bottom view of an essential portion of a first embodiment of the present invention.
Figure 5:
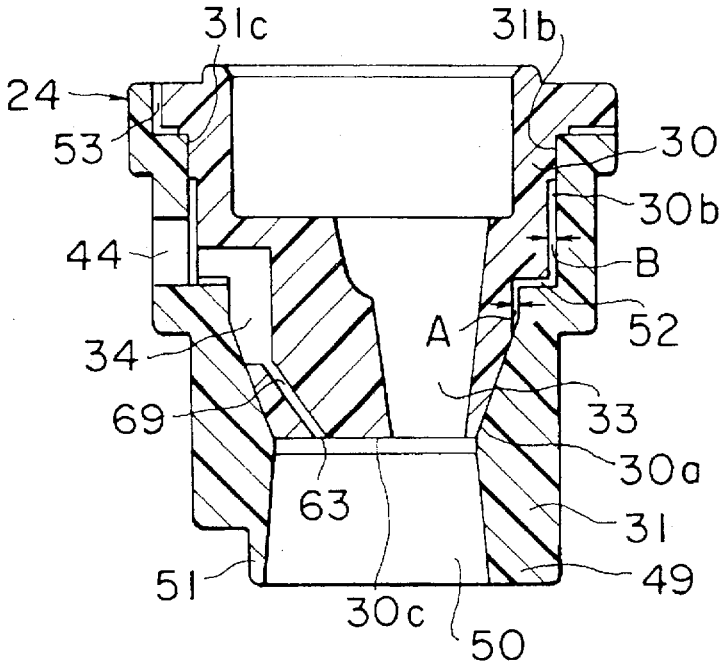
FIG. 5 is a cross-sectional view taken along the line V—V of FIG. 1.

As shown in FIGS. 1 and 5, the sleeve 24 is constituted by an inner sleeve nozzle 30 and an outer cover nozzle 31. The sleeve nozzle 30 and the cover nozzle 31 which form the sleeve 24 are made of a material such as 6-6 nylon (containing 30 wt % glass), polyacetal, or PPS (polyphenylene sulfide).

The inner sleeve nozzle 30 has two fuel flow separating holes 32 and 33. Each of the fuel flow separating holes 32 and 33 has a generally conical shape such that the sectional area is reduced in the downstream direction of a fuel jet. The inner sleeve nozzle 30 has a tapered surface **30*a* and an annular stepped portion 30*b*** in its outer wall surface.

The outer cover nozzle 31 has holes, e.g., six holes 44 and 45 (holes 45 not shown) for forming an air inlet to extend from its inner surface to its outer surface. The sectional area of each of the holes 44 and 45 suffices to be equal to or greater than the sectional area of a passage defined between a channel 34 or 35 (channel 35 not shown) and an inner surface of the cover nozzle 31. At an end portion of the cover nozzle 31 are formed a diffusion section 50 for guiding sprays of atomized fuel agitated by assist air, a skirt portion 49 for limiting the divergence of fuel spray angles, and a chamfered portion 51 for positioning at the time of automatic assembly. Gaps A and B shown in FIG. 5 are formed to provide a clearance of about 0.1 to 0.3 mm, thereby preventing fusing and welding of portions of the sleeve nozzle 30 and the cover nozzle 31 other than the stepped portion **30*b*** at the time of ultrasonic welding as well as clogging in the assist air passage caused by occurrence of an unnecessary burr.

As shown in FIG. 2, a passage inside the delivery pipe 2 through which fuel introduced through the fuel inlet flows is formed between a first O-ring 58 and a second O-ring 59. Air introduced via an air passage **2*a* formed in the delivery pipe 2 is sealed in a diametral direction between the second O-ring 59 and a third O-ring 60**.

As shown in FIGS. 1 and 5, the fuel flow separating hole 33 is formed to have a tapered cylindrical shape to be reduced in diameter toward its downstream end. A pair of air holes 62 and 63 in the form of straight slits having a constant width are opened in a lower end surface **30*c* of the sleeve nozzle 30 on the opposite sides of the opening ends of the fuel flow separating holes 32 and 33. The air slits 62 and 63 are formed in the vicinity of the opening ends of the fuel flow separating holes 32 and 33 on the lower end surface 30*c* of the sleeve nozzle 30. Opposite slit ends 62*a*, 62*b*, 63*a*, and 63*b* of the straight air slits 62 and 63 are closed in the vicinity of the sleeve nozzle outer wall. Intermediate air passages 68 and 69 (passage 68 is not shown) for supply of air, leading to the opening ends of the air slits 62 and 63 extend obliquely from the air passages constituted by channels 34**.

Figure 6:
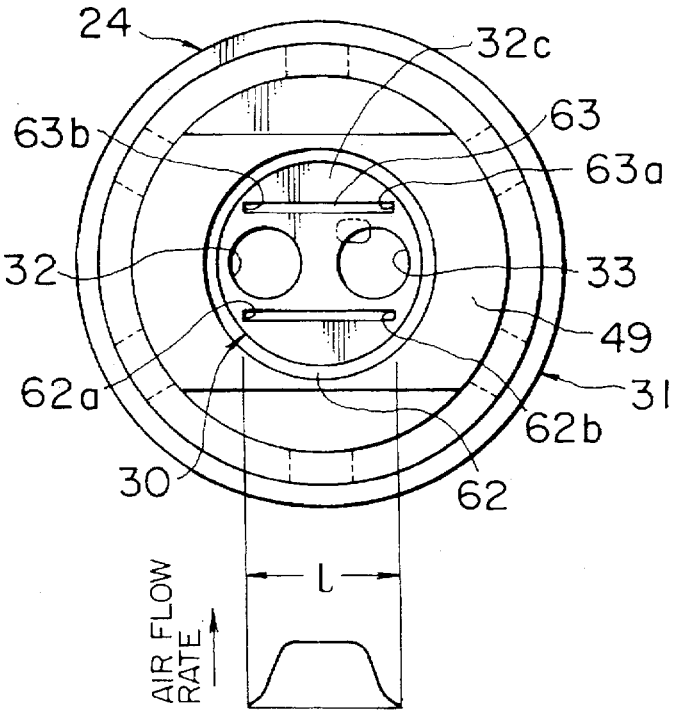
FIG. 6 is a diagram of an air flow rate distribution on slit-like air holes of the first embodiment.

Assist air flowing out of the air slits 62 and 63 has a flow rate distribution shown in FIG. 6. That is, the air flow rate is increased about a central portion of each of the air slits 62 and 63. Referring to FIG. 6, the length of the air slits 62 and 63 is selected to be longer than the distance between the centers of the two fuel flow separating holes 32 and 33 if no sub air hole is provided. This is because the effect of separating fuel in two directions is not adequate if the length of the air slits 62 and 63 is smaller than the distance between the centers of the two fuel flow separating holes 32 and 33.

Figure 7:
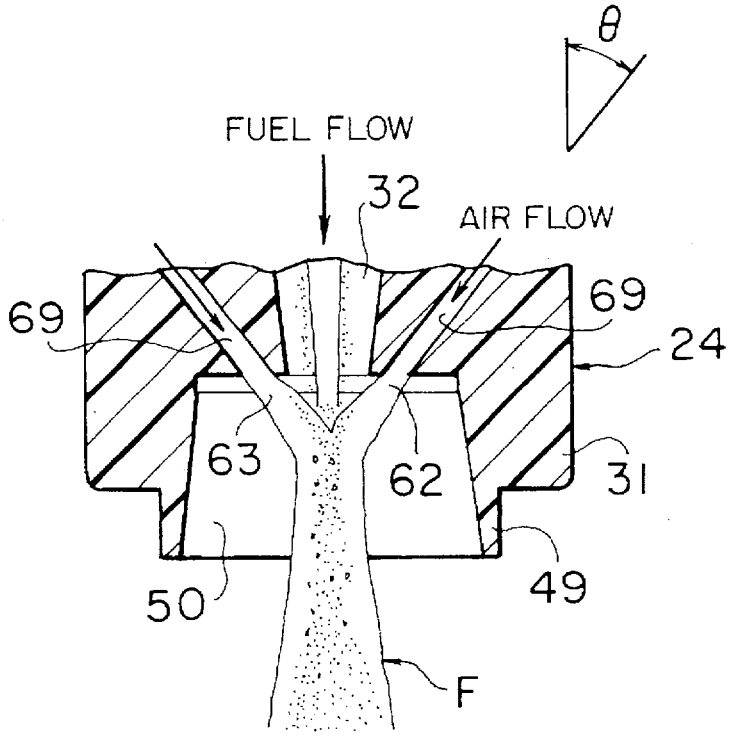
FIG. 7 is a schematic, cross-sectional view taken along the line VII—VII of FIG. 1, showing fuel and air flows of the first embodiment.

Next, flowing of mixture of fuel jetted through the fuel flow separating holes 32 and 33 and assist air jetted through the air slits 62 and 63 will be described with reference to FIGS. 7 and 8. FIG. 7 shows directions of fuel and assist air flows in a cross section taken along the line VII—VII of FIG. 1, and FIG. 8 shows directions of fuel and assist air flows in a cross section taken along the line VIII—VIII of FIG. 1.

Figure 8:
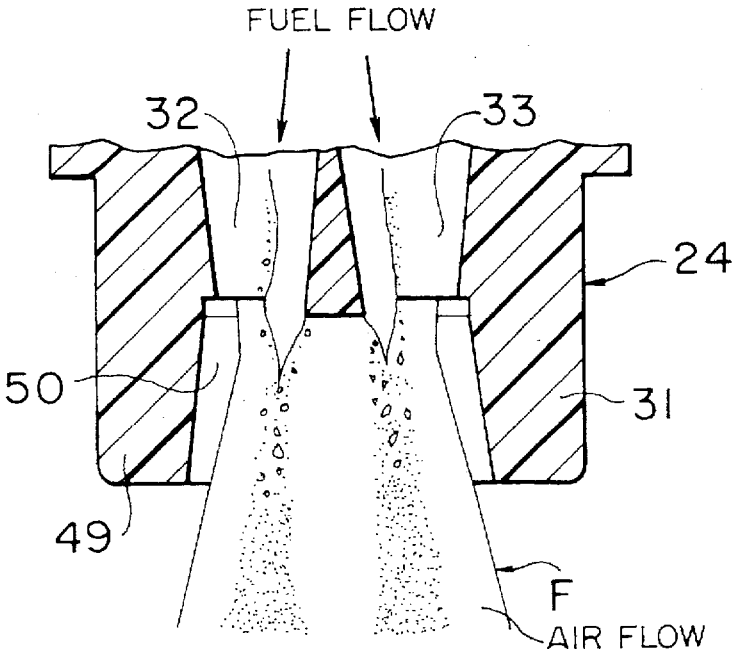
FIG. 8 is a cross-sectional view taken along the line VIII—VIII of FIG. 1, showing fuel and air flows of the first embodiment.

As shown in FIGS. 7 and 8, jets of fuel from the fuel flow separating holes 32 and 33 interfere with assist air flows from the air slits 62 and 63 inside the skirt portion 49, thereby forming a flat sectoral flow surface F. That is, by forming flat jets of assist air, fuel jets flowing from the fuel flow separating holes 32 and 33 are atomized while being separated from each other and caused to flow independently in two directions. Fuel-air mixture flows in two directions are thereby supplied as sprays while being separated from each other and being independently directed toward the intake valves on the opposite sides of the wall 114 shown in FIG. 3. Therefore, fuel thereby supplied to the combustion chamber 11 has such good characteristics that fuel can be completely combusted with air.

Specifically, in this embodiment, a wall or curtain of an assist air flow is formed by assist air flows from the air slits 62 and 63 so that sprays of atomized fuel can be positively separated in two directions. Moreover, by the effect of an air flow rate distribution shown in FIG. 6, the assist air flow wall is particularly strong at a central portion, so that the flows in two directions can be separated more positively. Also, atomization of sprayed fuel can be suitably maintained or promoted by relatively weak assist air flows from end portions of the air holes 62 and 63.

Referring to FIG. 7, if the assist air jet angle θ is excessively large, the fuel spray angle is so small that the penetrating force is insufficient. If the assist air jet angle θ is excessively small, fuel cannot be adequately separated in two directions and cannot be sufficiently atomized. Therefore, the angle of inclination of the air passage 69 is selected in view of the suitable range of the assist air jet angle.

Next, the procedure of manufacturing the sleeve 24 in accordance with the first embodiment will be described.

The cover nozzle 31 and the sleeve nozzle 30 are formed by injection molding. The cover nozzle 31 and the sleeve nozzle 30 are joined integrally with each other by inserting the sleeve nozzle 30 into the cover nozzle 31 and fusing these nozzles. The sleeve nozzle 30 is inserted through an opening 31*c* of the cover nozzle 31.

At the time of fusing, the sleeve nozzle 30 is inserted into the cover nozzle 31, and the stepped portion 30*b* and a stepped portion 31*b* are pressed against each other by pressing the cover nozzle 31 and the sleeve nozzle 30. In this state, the stepped portion 30*b* is melted by ultrasonic wave vibration. A burr caused by ultrasonic waves enters a burr receiving space 53, so that any adverse influence upon the O-ring 60 shown in FIG. 2 can be avoided. While the stepped portion 30*b* is being melted by ultrasonic waves, the sleeve nozzle 30 is press-fitted into the cover nozzle 31. The application of ultrasonic waves is stopped when the tapered surface 30*a* is brought into abutment against the cover nozzle 31.

In this welding process, during press-fitting of the sleeve nozzle 30 while melting the stepped portion 30*b*, the gaps A and B shown in FIG. 5 are maintained by a guide portion 52, thereby preventing generation of a burr due to unnecessary melting and welding.

Referring to FIG. 4, the sleeve nozzle 30 and the fuel injection valve 1 are assembled in such a manner that the sleeve nozzle 30 is press-fitted onto the outer circumference of the nozzle body 10 of the fuel injection valve 1 while a groove 10*a* and a projecting portion 30*c* are snap-fitted to prevent coming-off. Also at this time, the nozzle body 10 and the sleeve nozzle 30 are positioned in the direction of their relative rotation.

In the above-described embodiment, fuel introduced through the fuel inlet passes through a metering section and is jetted through the fuel injection holes 12, and the fuel jet is separated in two directions by the fuel flow separating holes 32 and 33 of the sleeve nozzle 30 and is immediately separated and atomized by air jets jetted through the passage 69 and air slits 62 and 63 to be directed to the two intake valves while being maintained in specified directions.

The above-described embodiment has fuel flow separating holes for separating a fuel flow in two directions since there are provided two intake valves. However, a fuel supply system can be designed easily to distribute fuel in three or more directions as desired.

Figure 9:
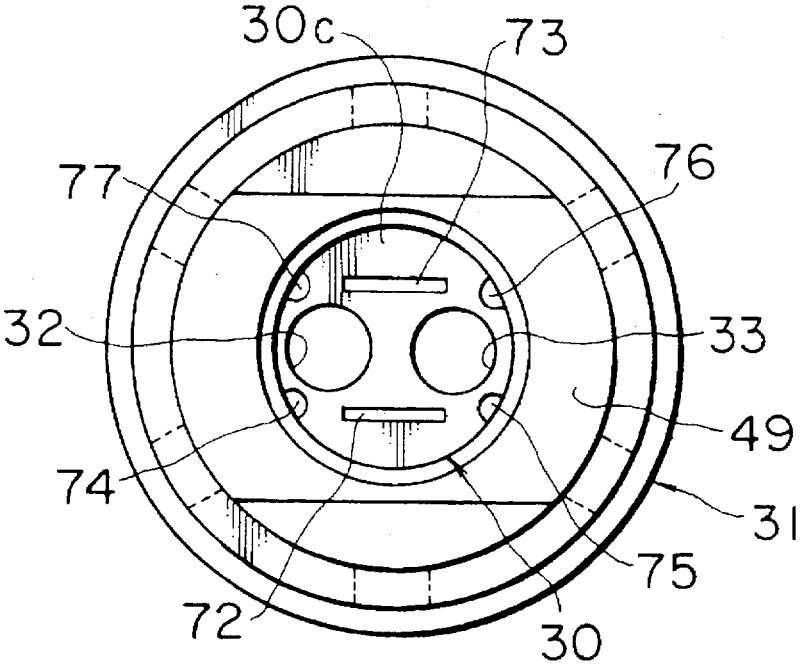
FIG. 9 is a bottom view of an essential portion of a second embodiment of the present invention.

A second embodiment of the present invention will be described with reference to FIG. 9.

In the second embodiment, four sub air holes 74, 75, 76, and 77 are formed while main air holes 72 and 73 in the form of straight slits are formed to be smaller in length in lengthwise directions. The sub air holes 74 to 77 are formed as grooves in outer wall portions of the sleeve nozzle 30.

According to the second embodiment, the main air holes 72 and 73 serve mainly to improve the function of separating a fuel spray in two directions, and the sub air holes 74 to 77 serve mainly to promote atomization of fuel.

Next, a third embodiment of the present invention will be described with reference to FIGS. 10 and 11.

In the third embodiment, main air holes 82 and 83 in the form of curved slits are provided in place of the main air holes 62 and 63 of straight slits in the first embodiment shown in FIG. 1. The main air holes 82 and 83 are opened in the lower end surface of the sleeve nozzle 30 in positions close to the fuel flow separating holes 32 and 33 with their central portions curved toward the center of the sleeve.

Figure 12:
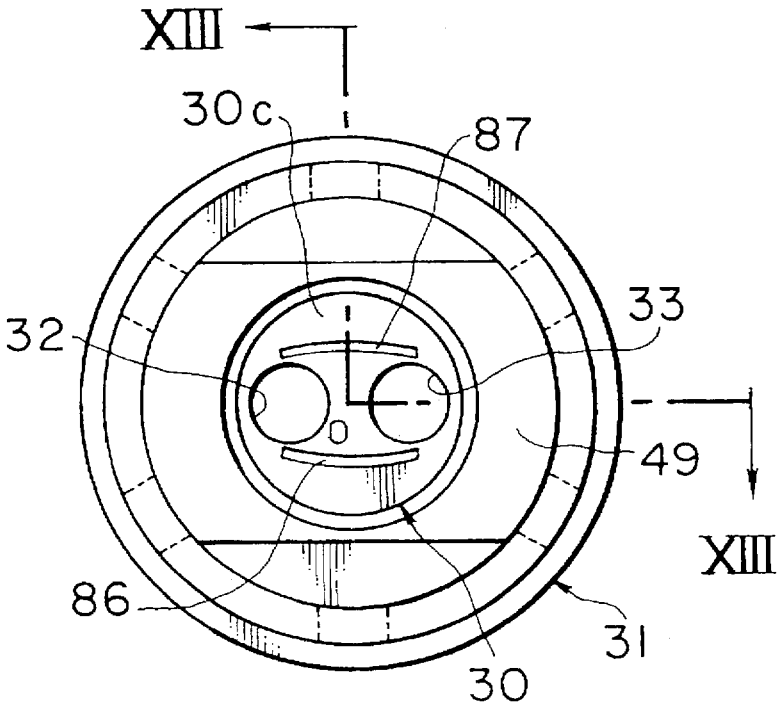
FIG. 12 is a bottom view of an essential portion of a fourth embodiment of the present invention.
Figure 13:
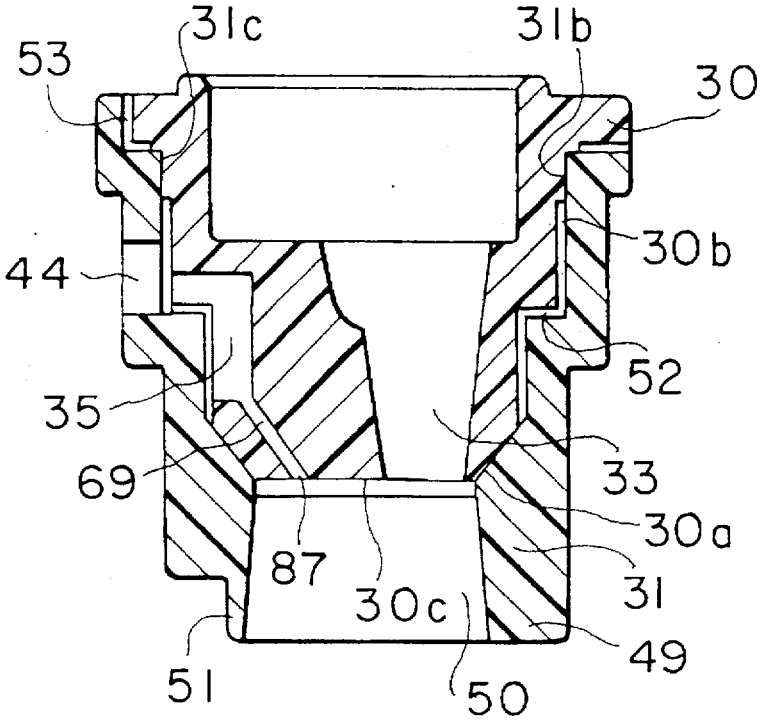
FIG. 13 is a cross-sectional view taken along the line XIII—XIII of FIG. 12.

Next, a fourth embodiment of the present invention will be described with reference to FIGS. 12 and 13.

Figure 10:
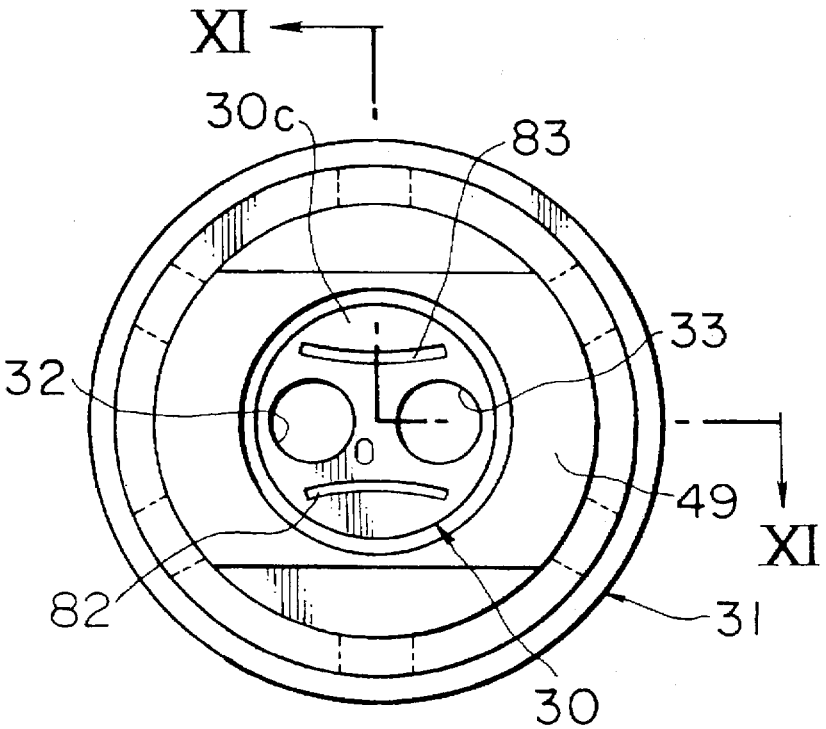
FIG. 10 is a bottom view of an essential portion of a third embodiment of the present invention.
Figure 11:
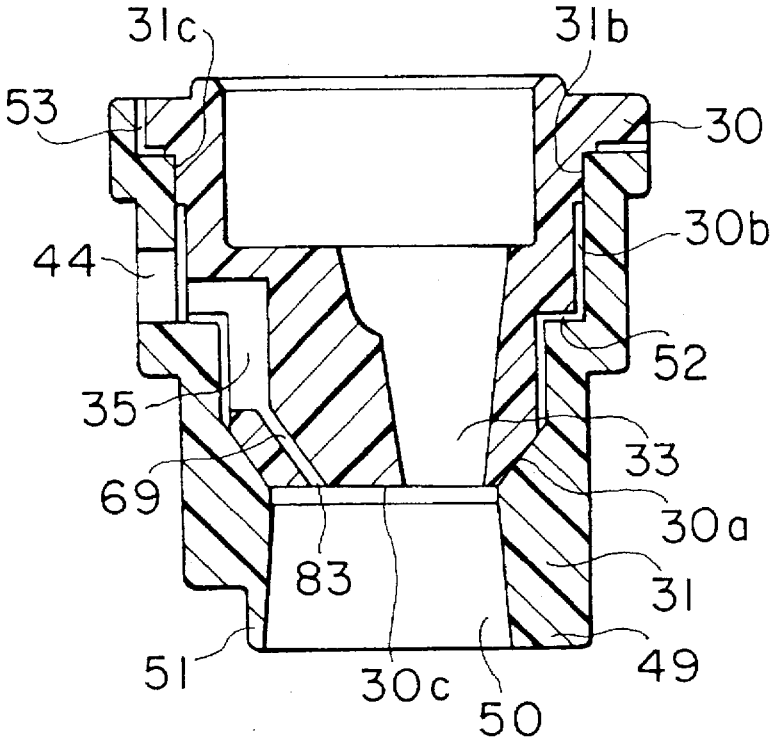
FIG. 11 is a cross-sectional view taken along the line XI—XI of FIG. 10.

In the fourth embodiment, main air holes 86 and 87 in the form of slits curved oppositely are provided in place of the curved main air slits 82 and 83 shown in FIG. 10. The main air holes 86 and 87 are opened in the lower end surface 30*c* of the sleeve nozzle 30 in positions close to the fuel flow separating holes 32 and 33 with their central portions curved in a centrifugal direction of the sleeve.

A fifth embodiment of the present invention will be described with reference to FIGS. 14 and 15.

In the fifth embodiment, main air holes 90 and 91 and sub air holes 92 and 93 are formed in place of the straight air slits 62 and 63 shown in FIG. 1. The main air holes 90 and 91 are formed to be smaller in length in lengthwise directions, and the sub air holes 92 and 93 are formed as grooves in outer wall portions of the sleeve nozzle 30.

Figure 16:
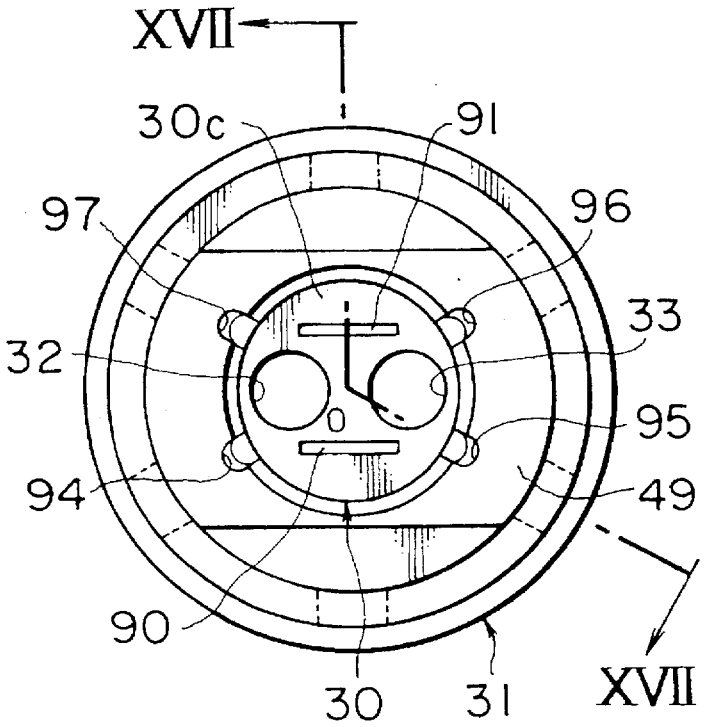
FIG. 16 is a bottom view of an essential portion of a sixth embodiment of the present invention.
Figure 17:
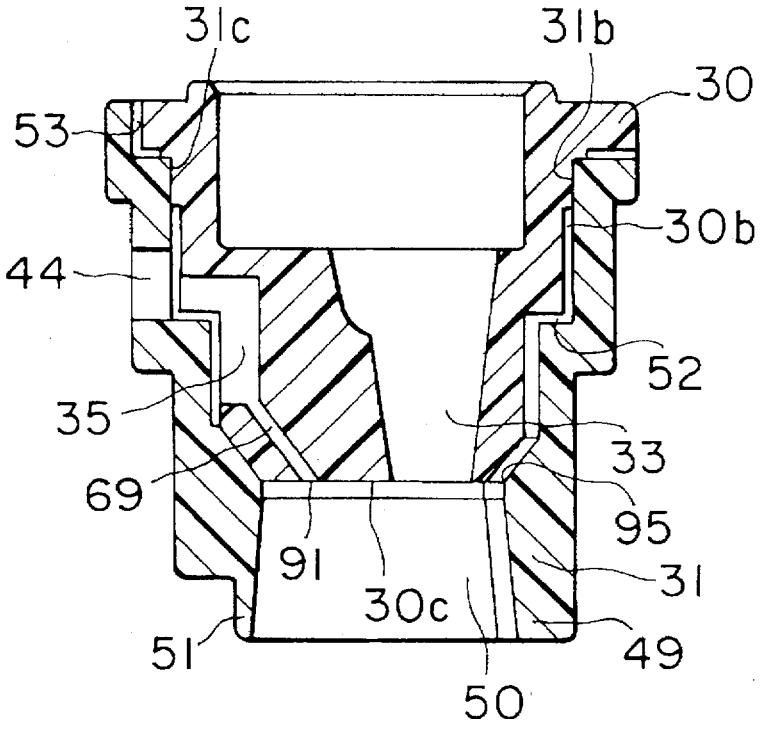
FIG. 17 is a cross-sectional view taken along the line XVII—XVII of FIG. 16.

A sixth embodiment of the present invention will be described with reference to FIGS. 16 and 17.

Figure 14:
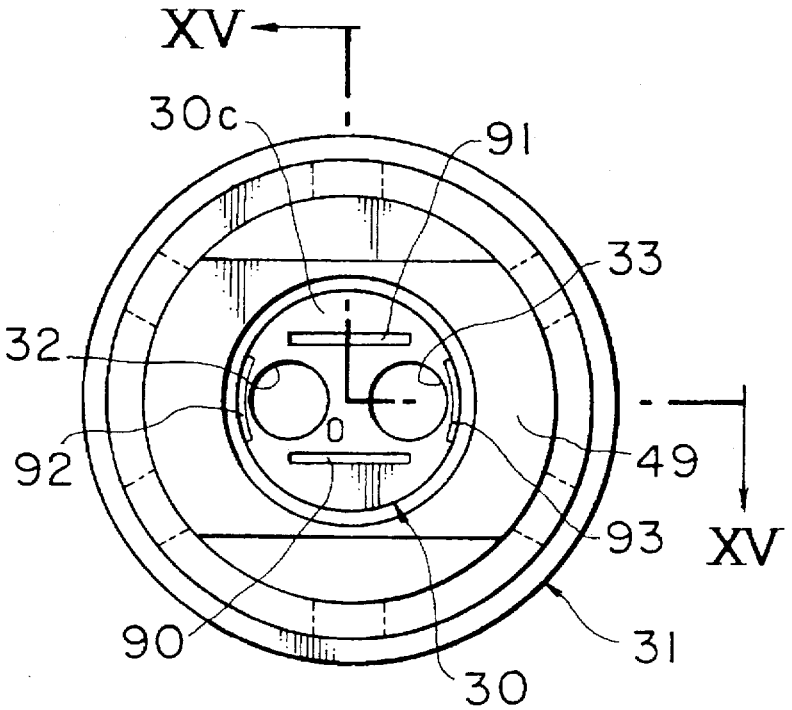
FIG. 14 is a bottom view of an essential portion of a fifth embodiment of the present invention.
Figure 15:
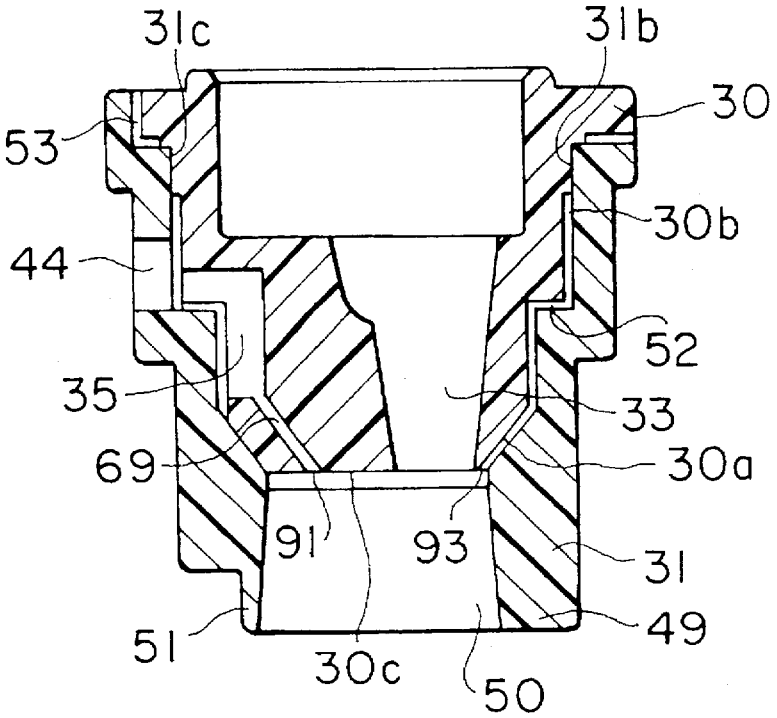
FIG. 15 is a cross-sectional view taken along the line XV—XV of FIG. 14.

In the sixth embodiment, four sub air holes 94, 95, 96, and 97 are formed in place of the curved sub air slits 92 and 93 shown in FIG. 14 to be recessed in the cover nozzle 31.

Figure 18:
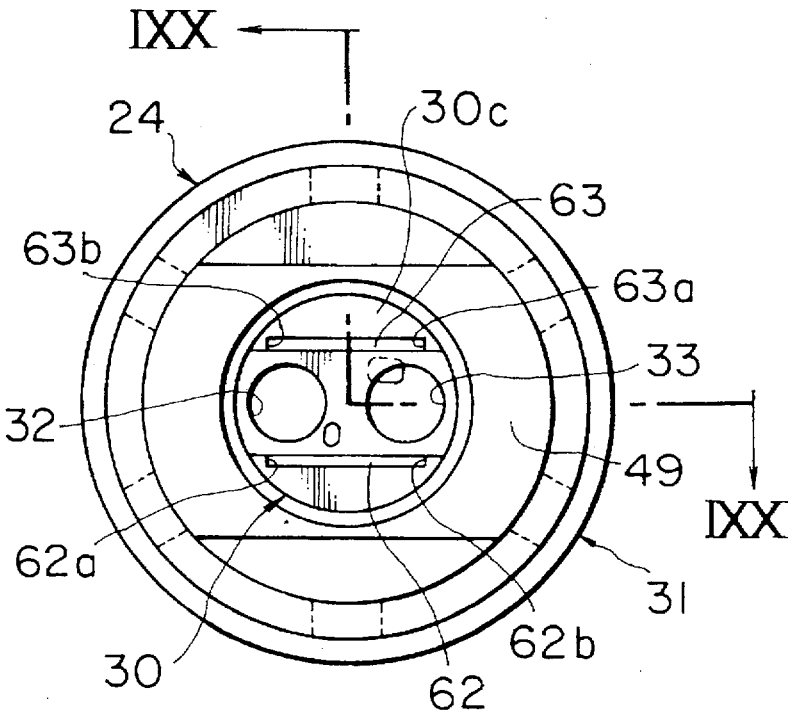
FIG. 18 is a bottom view of an essential portion of a seventh embodiment of the present invention.
Figure 19:
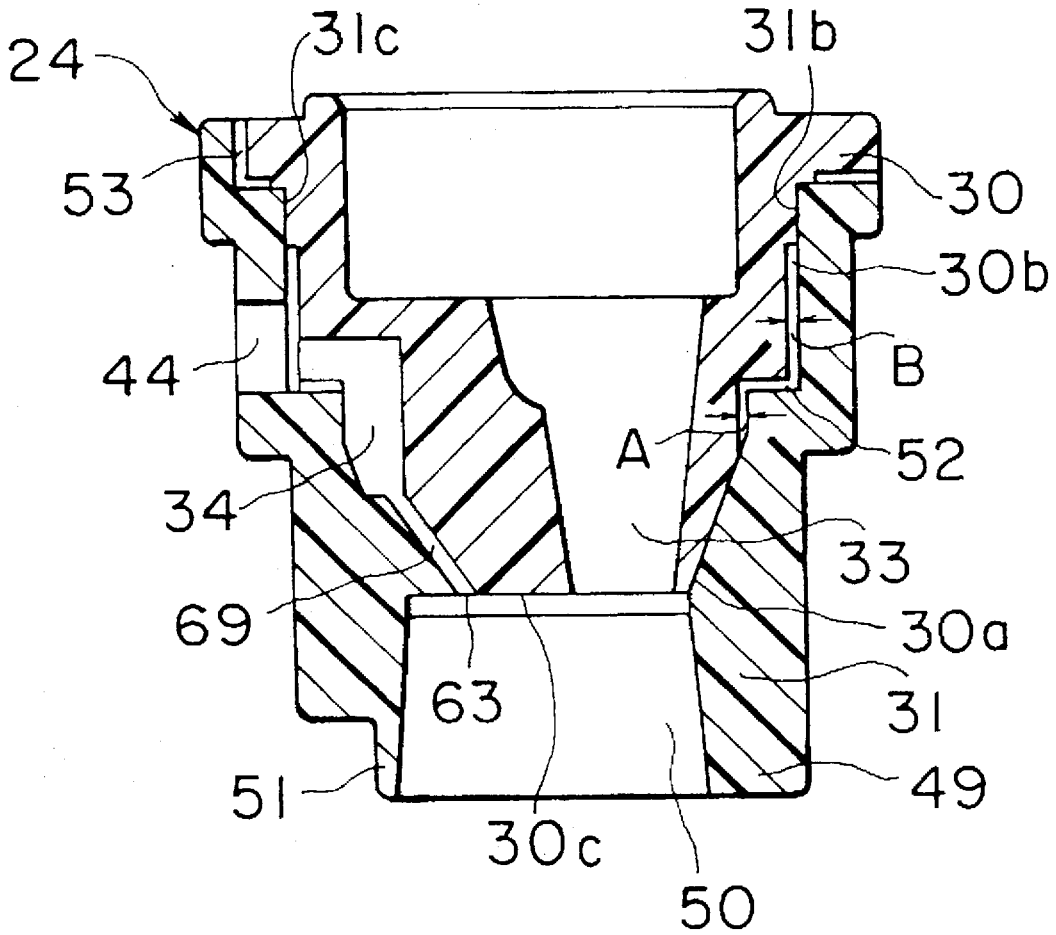
FIG. 19 is a cross-sectional view taken along the line IXX—IXX of FIG. 18.

In the first embodiment, the air passages 68 and 69 constituting a part of an assist air supply means are formed in the sleeve nozzle 30 by electric discharge machining, and the air slits 62 and 63 are formed to be open in the lower end surface 30*c* of the sleeve nozzle 30. Alternatively, the air passages 68 and 69 and the air slits 62 and 63 may be formed between the sleeve nozzle 30 and the cover nozzle 31. FIGS. 18 and 19 show this arrangement. In FIGS. 18 and 19, the reference numerals designate the same components as those of the first embodiment. The air passages 68 and 69 and the air slits 62 and 63 are formed between the sleeve nozzle 30 and the cover nozzle 31.

In the above-described embodiments, a fuel jet jetted from the single fuel injection hole 12 is distributed into fuel jets flowing in two directions through the fuel flow separating holes 32 and 33, and two assist air jets spreading two-dimensionally are caused to impinge against the distributed fuel jets from the opposite sides of the fuel jets in such a manner that the fuel jets are sandwiched between the assist air jets, thereby forming sprays of atomized fuel extending in two directions. Therefore, it is possible to suppress excessive spreading of the fuel sprays while improving the atomization of fuel and to maintain two suitable spraying directions.

The above-described embodiments may be modified in such a manner that a plurality of fuel injection holes are provided to form fuel sprays flowing in two or more directions. In the case of such an arrangement, a thin orifice plate is mounted in place of the fuel injection port 12, and a plurality of fuel injection ports are formed in this orifice plate. For example, four fuel injection ports having a fuel metering function are formed and two of these injection ports are directed together toward one of the intake valves while the other two injection ports are directed toward the other intake valve. In this case, the injector main body including the orifice plate serves as a fuel spray forming member. Further, substantially large holes are formed in place of the fuel flow separating holes 32 and 33, and fuel jets jetted from the orifice plate and flowing in two direction air supplied with dimensionally-spreading assist air jets on the opposite sides of the fuel jets. Accordingly, the atomization of fuel is promoted by a synergic effect of the fuel atomizing effect of the fuel injection ports in the orifice plate and the fuel atomizing effect of assist air. Also, the direction of fuel jetting can be suitably maintained by the two-dimensionally-spreading assist air jets.

Positions at which assist air jet flows impinge against the fuel jets must be selected according to the spray configuration. If the fuel jet outlets and the assist air jet outlets are close to each other, the direction of the assist air jets may be parallel to the fuel jets.

Further, two-dimensionally-flowing assist air jets may be applied to a single fuel jet flow, whereby spreading of a single fuel spray can be suppressed while the atomization of fuel is promoted.

In the above-described embodiments of the present invention, air holes in the form of slits extending straight or curvedly are formed on the opposite sides of injection hole openings, and assist air flows are jetted two-dimensionally from these air slits to impinge against fuel jets. This arrangement ensures that fuel jetted through the flow separating holes can be suitably atomized while being maintained in a state of being separated from each other and being caused to flow independently in two directions.

Thus, in the arrangement of the embodiments, flat flow surfaces can be formed because air slits are provided on the opposite sides of the two flow separating holes, and, by these flat flow surfaces, two fuel jets from the two flow separating holes can be suitably atomized and caused to flow constantly in the desired jetting directions without being mixed with each other. Moreover, spreading of the atomized fuel sprays in a vertical direction can be suppressed by the flat flow surfaces.

Specifically, due to the effect of jetting two-dimensionally-spreading assist air flows through the air slits, spreading of atomized fuel sprays is suppressed in a direction (illustrated as a vertical direction) perpendicular to the direction of arrangement of the two flow separating holes (illustrated as a horizontal direction), so that an amount of fuel attached to the intake passage wall is reduced. Also, the air slits are formed to be sufficiently long, whereby spreading of the atomized fuel sprays is suppressed in the direction of arrangement of the two flow separating holes (illustrated as a horizontal direction) without providing any sub air hole.

What is claimed is:

1. A fuel supply system for internal combustion engines which supplies a fuel spray combustible in a combustion chamber of the internal combustion engine, said fuel supply system comprising:

fuel jet forming means for forming a first fuel jet flowing in a first direction and a second fuel jet flowing in a second direction; and assist air supply means for supplying a first assist air jet in a first plane and a second assist air jet in a second plane substantially parallel to said first plane, said first fuel jet and said second fuel jet being disposed between said first plane and said second plane, said assist air supply means comprising a pair of slit-like assist air holes having slit-like openings such that said assist air jets atomize the fuel jets and confine the fuel jets between the assist air jets while maintaining two, separate fuel jet flows.

2. A fuel supply system according to claim 1, wherein said fuel jet forming means comprises:

valve means for injecting fuel; and fuel flow separating means for separating fuel passing through said valve means into said first and second fuel jets.

3. A fuel supply system according to claim 2, wherein said fuel flow separating means has a first flow separating hole through which said first fuel jet is jetted and a second flow separating hole through which said second fuel jet is jetted, said first and second flow separating holes being formed to have openings arranged on the same plane.

4. A fuel supply system according to claim 3, wherein said slit-like assist air holes open close to said first and second flow separating holes and extend along both sides of the direction of arrangement of said first and second flow separating holes.

5. A fuel supply system according to claim 4, wherein said assist air holes comprise holes inwardly inclined so that assist air jets impinge against the fuel jets from said both sides of the fuel jets.

6. A fuel supply system according to claim 5, further comprising a sleeve mounted on an end of a nozzle body of the fuel injecting valve, said sleeve having an inner sleeve nozzle and an outer cover nozzle, said sleeve nozzle constituting said fuel flow separating means.

7. A fuel supply system according to claim 6, wherein assist air passages are formed between said sleeve nozzle and said cover nozzle, said slit-like assist holes being formed through said sleeve nozzle.

8. A fuel supply system according to claim 6, wherein assist air passages are formed between said sleeve nozzle and said cover nozzle, said slit-like assist air holes being formed between said sleeve nozzle and said cover nozzle.

9. A fuel supply system according to claim 1, wherein said fuel jet forming means comprises at least two fuel holes arranged side by side for supplying said first and second fuel jets, and said slit-like openings extend parallel to the direction of arrangement of said two fuel holes and on said both sides.

10. A fuel supply system according to claim 1, wherein said first fuel jet is directed to a first intake valve of the internal combustion engine while said second fuel jet is directed to a second intake valve of the internal combustion engine.

11. A fuel supply system according to claim 10, wherein said assist air holes extend along the direction of arrangement of said first and second intake valves.

12. An air assist sleeve used in combination with a fuel injection valve for metering and jetting fuel to supply a fuel spray combustible in a combustion chamber of an internal combustion engine, said air assist sleeve comprising:

air holes means having a pair of slit-like openings providing a first assist air jet in a first plane and a second assist air jet in a second plane substantially parallel to said first plane; and fuel hole means being disposed between said first plane and said second plane and having at least a pair of fuel holes which jet first and second fuel jets, respectively, said first and second fuel jets being atomized and confined by the assist air jets such that two, separate jets are maintained.

13. An air assist sleeve according to claim 12, wherein said air holes are formed to be inclined such that the fuel jet passed through said fuel hole means and the assist air jets interfere with each other.

14. An air assist sleeve according to claim 13, wherein said fuel hole means comprises a fuel jet separating member for forming said first and second fuel jets.

15. A method of forming sprays in a fuel supply system for supplying fuel sprays combustible in a combustion chamber of an internal combustion engine, said method comprising the steps of:

forming at least a first fuel jet and a second fuel jet flowing in different directions;

forming a first assist air jet in a first plane;

forming a second assist air jet in a second plane substantially parallel to said first plane, said first fuel jet and said second fuel jet being disposed between said first plane and said second plane; and causing the assist air jets to interfere with the first and second fuel jets after the first and second fuel jets have jetted a predetermined distance and said assist air jets have also jetted a predetermined distance, whereby the first and second fuel jets are atomized to form a first fuel spray and a second fuel spray while each of the first and second fuel jets is maintained as two separate fuel sprays.

16. A method according to claim 15, wherein the first and second fuel jets are contained in a flow surface formed by the assist air jets.

* * * * *